United States Patent [19]

Wasem et al.

[11] Patent Number: 4,747,444

[45] Date of Patent: May 31, 1988

[54] AUTOMATED CASTING PLANT AND METHOD OF CASTING

[75] Inventors: John W. Wasem, Hazel Crest; Donald E. Meves, Olympia Fields, both of Ill.; Robert F. Kenzler, Milwaukee, Wis.

[73] Assignee: Amsted Industries Incorporated, Chicago, Ill.

[21] Appl. No.: 729,947

[22] Filed: May 2, 1985

[51] Int. Cl.[4] ..... B22D 46/00; B22D 47/02

[52] U.S. Cl. ..... 164/457; 164/4.1; 164/5; 164/130; 164/137; 164/150; 164/154; 164/155; 164/458

[58] Field of Search ..... 164/5, 4.1, 457, 130, 164/137, 155, 154, 150, 458

[56] References Cited

U.S. PATENT DOCUMENTS

| | | | |
|---|---|---|---|
| 2,134,117 | 10/1938 | Floyd et al. | 164/130 X |
| 2,882,567 | 4/1959 | Deakins et al. | 164/155 |
| 3,303,536 | 2/1967 | Pegon | 164/137 |
| 3,319,728 | 5/1967 | Johansson et al. | 164/155 X |
| 4,037,761 | 7/1977 | Kemlo et al. | 222/590 |
| 4,134,444 | 1/1979 | Fujie et al. | 164/155 |
| 4,224,979 | 9/1980 | Rosin et al. | 164/130 |
| 4,470,445 | 9/1984 | Mangan et al. | 164/155 X |

FOREIGN PATENT DOCUMENTS

| | | | |
|---|---|---|---|
| 3007347 | 9/1981 | Fed. Rep. of Germany | 164/155 |
| 203834 | 11/1983 | Fed. Rep. of Germany | 164/130 |
| 8100976 | 4/1981 | World Int. Prop. O. | 164/457 |
| 959916 | 9/1982 | U.S.S.R. | 164/457 |

*Primary Examiner*—Nicholas P. Godici
*Assistant Examiner*—J. Reed Batten, Jr.
*Attorney, Agent, or Firm*—Charles E. Bouton; Edward J. Brosius

[57] ABSTRACT

Sand molds stored in a prepour storage system are retrieved and conveyed to a pouring station with a total mold cavity capacity equal to the amount of molten metal to be poured. Despite the fact that the mold cavities vary in size they are delivered to the pouring station in a sequence that accomodates delivery of the molds having variable metal capacity to one of a plurality of cooling conveyor lines so that each cooling line conveys molds which require variable lengths of time to cool before such molds can be conveyed into a punch-out where the cope flask is stripped and the sand mass and castings are pushed up from the drag flask and onto a shakeout which conveys sand to a reclaim system and castings to a processing area where the castings are shot blasted, gates and risers are removed, the castings are inspected, flame washed, welded (as needed), ground, chipped, heat treated and then blast cleaned a second time before final grinding, chipping, gauging, final inspection, assembly and storage. The mold flasks are cleaned, new mold cavities formed therein and are reassembled and then stored in the prepour storage system where their location is recorded by a computer for selective retrieval for the next heat to be poured.

6 Claims, 3 Drawing Sheets

AUTOMATED CASTING PLANT AND METHOD OF CASTING

This invention relates to improvements in the art of metal founding and more particularly to a physical arrangement for, and a method of operating, a foundry plant.

A primary object of the invention is to devise such a plant which can be operated by a minimum amount of skilled labor.

Another object of the invention is to provide for automatic transfer of molds, molding materials and castings to various areas of the plant as required to obtain high quality finished product.

Still another object of the invention is to use all of the metal in a heat thereby minimizing waste.

Yet another object of the invention is to increase the efficiency of cooling castings in their molds by providing a plurality of inter-related cooling lines each containing molds with various amounts of molten metal, because such a heat usually requires that some molds contain more metal than others.

Figure 1A:
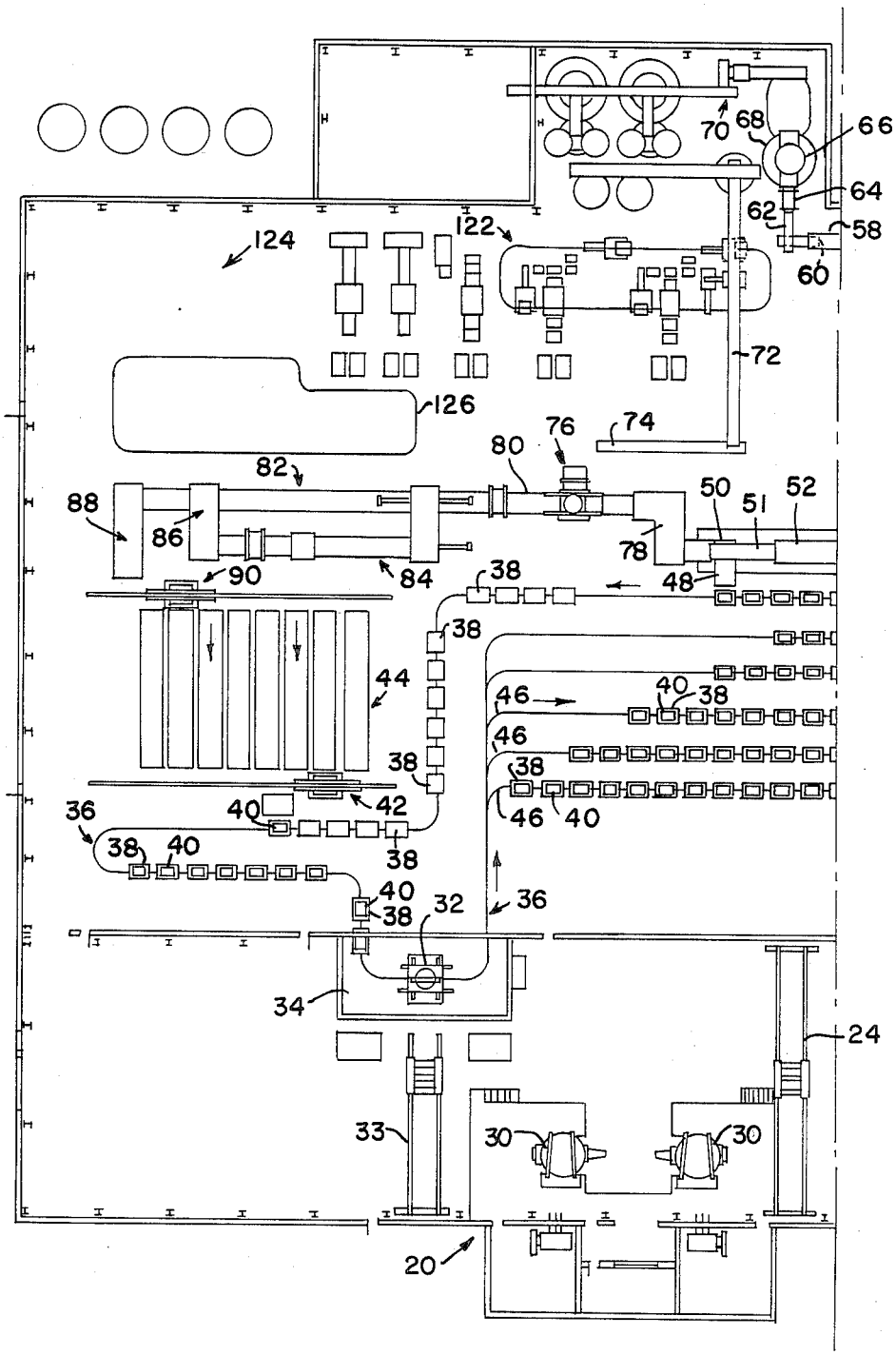
Figure 1B:
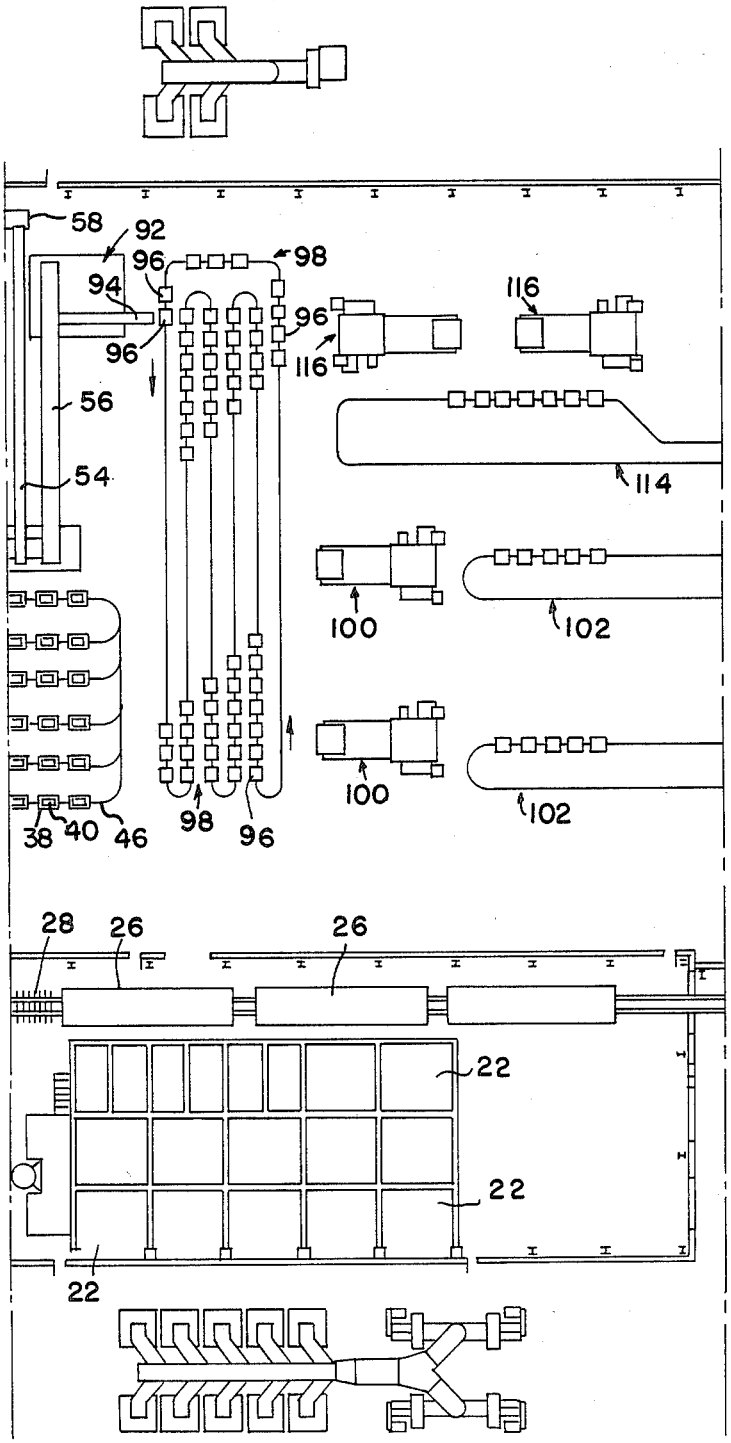
Figure 1C:
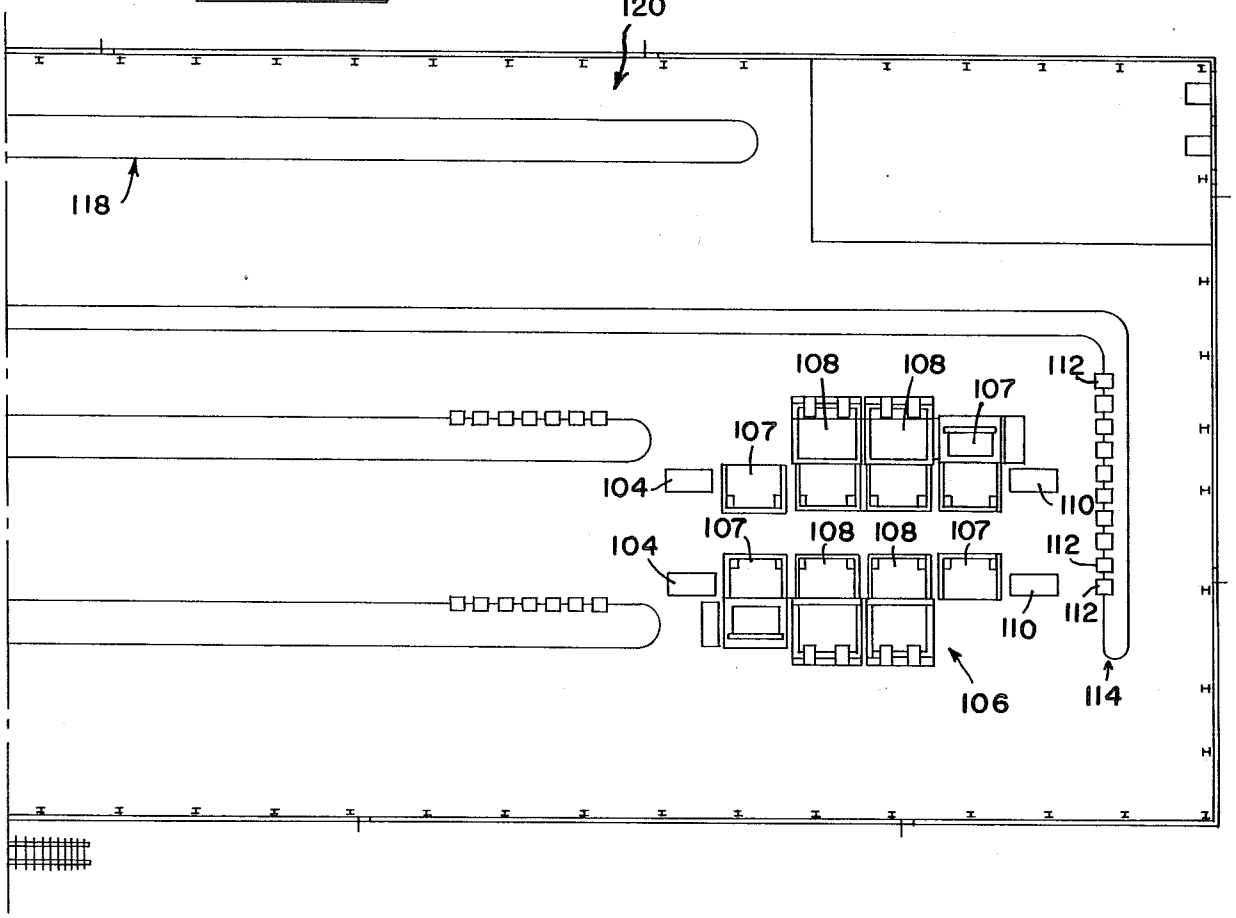

The foregoing and other objects and advantages of the invention will become apparent from a consideration of the following specification and the accompanying drawings wherein FIGS. 1*a*, 1*b* and 1*c* are intended to be read as a single schematic plan view of a novel foundry plant embodying a preformed form of the invention.

Describing the invention in detail and referring first to FIGS. 1*a* and 1*b*, a melted area generally designated 20 comprises scrap storage bins 22 loaded by a crane 24, as from railway freight cars 26 on a sliding 28. The melted metal area 20 also comprises two arc furnaces 30 each capable of producing, for example, a twelve ton heat of steel suitable for railway castings, comprised principally, but not limited to, couplers, coupler knuckles and yokes. Larger or smaller heats may be produced, as desired.

After a heat of molten steel has been tapped from a furnace 30 into a bottom pour ladle 32 the ladle is moved by a crane 33 from the furnace to a pouring station 34 whereat molds are delivered by a conventional inverted power and free conveyor system 36 comprising mold support trays 38 each adapted to carry a mold 40 placed on its tray by a transfer mechanism 42 at a prepour mold storage system generally designated 44 which is two-tiered with a capacity of about 160 such molds having mold cavities of various sizes retrieved from the system 44 in a selective manner so that the total number of mold cavities in a given sequence of molds will use all of the molten steel in the heat without left-over metal in the ladle. Other designs of conveyors may be used, if desired.

The conveyor system 36 is known as a power and free system because the trays 38 do not move continuously but are stationary until moved by a power source activated in response to a signal from an operator or computer or to an automatic mechanism such as a dog on a chain (not shown).

Pouring continues until the last mold to be poured evidences slag whereupon delivery of molds to the pouring station is terminated and the last curing is scrapped. This results in 100% use of the molten steel in a heat. Inasmuch as the storage system 44 will only deliver enough molds to use all of the molten metal in a heat, only rarely will there be a left-over mold to return to storage. This could be caused under unusual conditions as, for example, the presence of excessive slag.

After the trays 38 pass from the pouring system 34 they enter one of a plurality of cooling lines 46 of the conveyor system 36 said cooling lines being shown in the drawing as being five in number, for example, although more or less could be used. The lines 46 move the trays at a preselected rate of speed dependent upon the amount of metal in the molds so that the cooling time for each line is automatically regulated as described and as preselected. The molds 40 are automatically retrieved from the storage system 44 in such a sequence that the molds in each cooling line 46 have substantially the same cooling rates even though the molten metal capacity of the molds in each line 46 varies due to product design. When the molds 40 in each line 46 have been adequately cooled they are delivered one at a time to an automatic mold removal mechanism 48 which transfers the mold from its tray 38 to a flask separator 50 where the cope flask is stripped from the drag flask and the drag flask containing the sand, as well as the castings, is transferred into a conventional punchout which pushes the sand mass and casting up and out of the drag flask thus allowing a platen actuated by a cylinder to push the mass away from the drag flask onto a conveyor 51 constructed with replaceable abrasion resistant steel liners capable of withstanding a vertical drop of forty eight inches by a casting weighing as much as fifteen hundred pounds at about 1200° F. The punchout conveyor 51 delivers sand and castings to a heavy duty high frequency vibrating foundry shakeout 52 which delivers sand to a trough belt or vibrating conveyor 54 and delivers the castings to a vibrating conveyor 56.

The sand conveyor 54 delivers the sand from the shakeout 52 to a vibrating conveyor 58, the last five feet of which is constructed of nonmagnetic material such as stainless steel. An inline overhead magnetic separator 60 overlies said nommagnetic materials for removing steel particles from six inches of sand from a distance of nine inches above the nonmagnetic segment of the conveyor 58.

The vibrating conveyor 58 delivers the shakeout sand to another vibrating conveyor 62 which delivers such sand to a centrifugal discharge foundry type bucket elevator 64 which discharges such sand to a suitable vibrating screen 66 through which the sand passes to a bin 68 for delivery to a sand reclaim system 70, such as is common in the steel foundry industry, to prepare the sand for use in another mold.

The reclaimed and prepared sand is delivered by belt conveyors 72 and 74 to the vicinity of a molding machine 76 which produces cope and drag sand mold flasks from empty flasks delivered from a flask cleanout station 78.

The molding machine 76 may be of any conventional design but preferably is an impact machine wherein sand is impacted against a pattern by explosion of a mixture of natural gas and atmosphere in a shell attached to the flask. Such a machine may be equipped with a pattern shuttle to alternate the cope and drag patterns. If desired a conventional jolt and squeeze machine may be used to form the sand against the pattern. A mold drag is made and indexed to a strike-off station 80 at the same time a cope flask and pattern are indexed into the molding machine. After the sand at the bottom of the mold drag has been struck-off as by a metal bar (not shown) actuated manually or by a power cylinder (not shown) the drag flask is inverted and indexed to the drag core setting line 82 while the cope is transferred 90° to a cope line 84 parallel to the drag line 82. Preferably the cores which are set in the mold drags at area 82 are made in an adjacent area 122 by conventional techniques and conventional equipment and materials. The finished cores are stored at an area 124 and are delivered to the core setting area 82 by a conveyor 126 which is preferably of conventional overhead monorail design. Cores are made by a conventional no-bake process and are delivered "just-in-time" to the mold core setting line or lines so as to arrive as needed for placing in the molds. The cope is then inspected and transferred 90° to a closing station 86, and the drag containing the cores is transferred to the closing station where the cope is inverted and lowered to the drag thereby completing the mold 40. The completed mold 40 is then transferred to a pick-up station 88 where it is loaded by a transfer car 90 into the storage system 44 which records its position by a computer for selective retrieval as heretofore discussed.

The vibrating conveyor 56 delivers the castings to a gate and riser cut off station 92 with a manipulator (not shown) to position the casting and another manipulator (not shown) to cut off the gate and riser. The castings are then moved by a conveyor 94 to a box or tray 96 on another conveyor, for example an inverted power and free conveyor 98. The casting is loaded into the box 96 by a manipulator (not shown) and is carried by the conveyor 98 through a casting cooling zone until it reaches one or the other of two blast cleaning machines 100 whereat the box 96 is tipped to dump the casting into the blast cleaning machine 100. The blast machine may be of continuous type with a throughfeed conveyor which can be automatically loaded by conveyor 98. After blast cleaning, the castings are moved by a similar conveyor 102 for inspection, flame washing, gaging, chipping and grinding before delivery to a load table 104 in a heat treatment area 106. If desired the cut-off station may be moved so as to be served by a conveyor 102 so that the castings will be blasted before removal of gates and risers. This reduces labor and energy usage in burning off gates and risers with adhering sand. The castings are loaded into a rack (not shown) by a moving manipulator (not shown) which is used to deliver the loaded rack to a high temperature heat treatment furnace 107 and then lower into a quench tank 108, and then return to the same or similar furnace for temperings and finally to an unload table 110 where the castings are unloaded from the rack and loaded onto separate trays or boxes 112 of another inverted power and free conveyor system 114. The trays 112 are tipped to dump the castings into one or the other of two post heat treatment blast cleaning machines 116, from which they are taken by a similar conveyor 118 through an area 120 for computerized automatic chipping, gauging, final inspection, robotic wear plate weld application, assembly, palletizing and storage.

What is claimed is:

1. A foundry comprising a mold storage area containing a plurality of molds of each of several cavity sizes, a pouring area, means for selectively retrieving molds from said storage area, means for pouring molten metal into said molds at said pouring area, a plurality of moving cooling conveyor lines each having separate preselected cooling times and means for delivering poured molds to respective cooling conveyor lines in a preselected sequence whereby molds of the same size mold cavities will be moved through the same cooling conveyor line.

2. A casting plant comprising a station for pouring molten metal into molds, a storage station for preassembled molds of different metal capacities, and means for automatically delivering to said pouring station from said storage station a sufficient number of said molds having a total metal capacity equal to the amount of molten metal available at the pouring station without left-over metal at the pouring station.

3. A method of casting a plurality of molds available from a supply of pre-assembled molds of different cavity sizes comprising preparing a heat of molten metal having a known quantity of such metal, then preselecting a plurality of such molds having a total metal containing capacity equal to said quantity and then pouring said heat until all of said molds have been poured.

4. A method according to claim 3 wherein each poured mold is moved along one cooling line selected from a plurality of cooling lines having different cooling times according to mold cavity size whereby all molds of substantially the same cavity size are cooled for a preselected time.

5. A method according to claim 4 wherein each of said cooling lines is operated at preselected speeds.

6. A method according to claim 4 wherein said separate cooling lines are operated at different speeds.

* * * * *